United States Patent [19]

Rosier

[11] 4,267,442

[45] May 12, 1981

[54] ELECTRON MULTIPLIER DEVICE COMPRISING MICROCHANNEL PLATES WITH OPTICAL FEEDBACK SUPPRESSION FOR IMAGE INTENSIFIER TUBES

[75] Inventor: Jean-Claude Rosier, Paris, France

[73] Assignee: U.S. Philips Corporation, New York, N.Y.

[21] Appl. No.: 66,136

[22] Filed: Aug. 13, 1979

[30] Foreign Application Priority Data

Aug. 21, 1978 [FR] France ..... 78 24255

[51] Int. Cl.[3] ..... H01J 40/14

[52] U.S. Cl. ..... 250/207; 313/103 CM

[58] Field of Search ..... 250/207, 213 VT; 313/103 CM, 105 CM

[56] References Cited

U.S. PATENT DOCUMENTS

| | | | |
|---|---|---|---|
| 3,374,380 | 3/1968 | Goodrich . | |
| 3,461,332 | 8/1969 | Sheldon | 250/213 VT X |

*Primary Examiner*—David C. Nelms
*Assistant Examiner*—Darwin R. Hostetter
*Attorney, Agent, or Firm*—Marc D. Schechter

[57] ABSTRACT

An electron multiplier device comprises two superposed microchannel plates. At their common interface, the angle of the axis of the channels of the plates is on the order of from 25° to 30° so as to increase the number of optical reflections in the channels. The more reflections, the lower the optical feedback from the output of the multiplier. At least one of the plates comprises curved channels. The curvature of the channels is such that at the entrance and the exit of the multiplier the axis enclose a small angle of at the most 10° with the normals to the faces of the plates.

5 Claims, 5 Drawing Figures

ELECTRON MULTIPLIER DEVICE COMPRISING MICROCHANNEL PLATES WITH OPTICAL FEEDBACK SUPPRESSION FOR IMAGE INTENSIFIER TUBES

BACKGROUND OF THE INVENTION

The present invention relates to an electron multiplier device comprising microchannel plates with optical feedback suppression which can be used, for example, in image intensifier tubes.

Hereinafter, "optical feedback" is to be understood to mean the light which is emitted by the screen of an image intensifier tube, in reaction to the detection of an electron, and which passes to the interior of the tube to reach the photocathode. Optical feedback of this kind can excite the photocathode and can start a reaction process which leads to overdriving and destruction of the tube. The effect of this feedback is a problem when the intensifier operates with a very high gain such as, for example, when use is made of an imaging technique involving the counting of photons when the gain is on the order of $10^7$ photons emitted by the screen for each photon detected (or photoelectron released) by the cathode.

For the contruction of image intensifier tubes, various arrangements are known which aim to reduce such optical feedback. Thus, the inner side of the screen is provided with a metallic diaphragm, generally made of aluminium, for the outward reflection of the light emitted to the interior of the tube by the screen. However, this diaphragm comprises microholes. Also, the opacity of the diaphragm, instead of being absolute, even the best of cases is not better than on the order of $10^5$. As a result, optical feedback is not eliminated.

Another arrangement concerns the use of microchannel plates as electron multipliers. The light emitted to the tube interior necessarily passes through the microchannels where it is at least in part subjected to numerous reflections from the walls. Each reflection is accompanied by absorption of light. This results in an attenuation of the light passing through the microchannel plate which is estimated to be on the order of 100 in the case of a plate with straight channels and on the order of 1000 in the case of a plate comprising curved channels of the kind described in French Patent Specification No. 2,168,861. The optical feedback which still persists at the entrance of the plate corresponds essentially to the light emitted by the screen in directions near to the directions of the channel axis at the exit of the plate.

A more effective known arrangement involves the use of an electron multiplier in the form of a "chevron" assembly of two superposed plates comprising straight channels as described in U.S. Pat. No. 3,374,380. Actually, while the light emitted by the screen in the direction of the axis of a straight channel passes therethrough without being reflected from the walls and thus without attenuation, this light is necessarily subjected to reflections in the channels of a chevron assembly of two channels. The number of reflections in such an assembly and the attenuation is larger as the angle enclosed by the axes of the channels is made larger. The maximum permissible value of this angle is limited, this value being linked to the limits which may not be exceeded by the inclinations of the normals to the faces of the channel plate with the axes of the channels of the two plates. At the entrance of the first plate, the inclination limit is in the order of 10° in order to ensure suitable detection of the photoelectrons. At the exit of the second plate, the inclination limit has the same order of magnitude in order to prevent the image spot from becoming elliptical, which would lead to a loss of resolution in the direction of the main axis of the ellipse and which would be difficult to handle by data processing systems situated on the tube and employing, for example, a Plumbicon (trademark) brand camera tube and a system for digitizing the signal as regards amplitude and position.

SUMMARY OF THE INVENTION

The present invention relates to an electron multiplier device which comprises two microchannel plates in cascade connection, but the angle of the directions of the channels at the common interface of the two plates can assume values which are much higher than in the prior art so as to increase the number of light reflections on the walls of the microchannels and hence to reduce the optical feedback. This is done, however, without reducing the detection efficiency of the photoelectrons at the entrance of the multiplier and without deterioration of the image spot contour at the exit. To this end, the invention combines two plates, at least one of which comprises curved channels, the angle of the directions of the channels at the interface of the plates being permitted to reach from 25° to 30 ° while, due to the curvature of the channels at the entrance as well as at the exit of the multiplier, the axis of the channels enclose a small angle with the normals to the faces of the plates. An upper limit on the latter angle is on the order of magnitude of 10°.

BRIEF DESCRIPTION OF THE DRAWINGS

The invention will be better understood on the basis of the following description of some embodiments, given by way of example, which is accompanied by the following figures.

DESCRIPTION OF THE PREFERRED EMBODIMENTS

Figure 1:
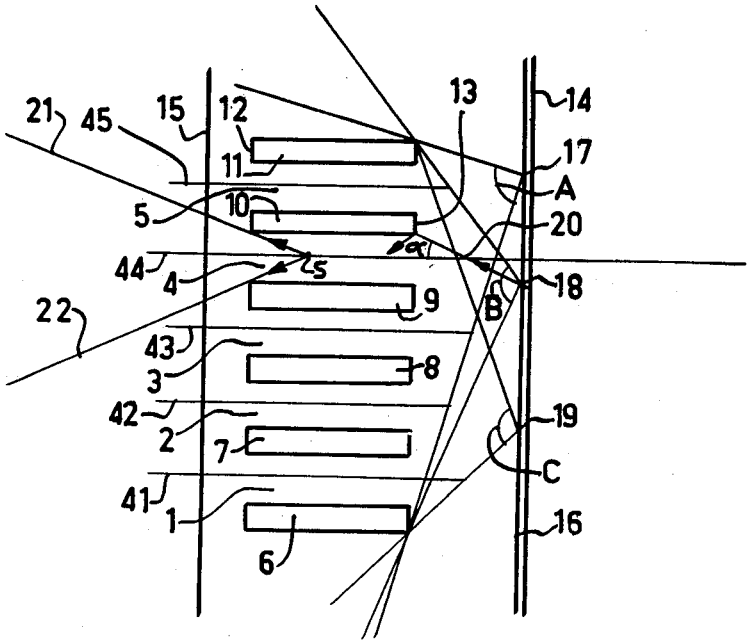
FIG. 1 shows an optical feedback diagram in an image intensifier tube comprising a microchannel plate.

FIG. 1 is a sectional view of a part of an image intensifier which comprises only one microchannel plate with straight channels. Each of the reference numerals 1, 2, 3, 4, 5 denotes a microchannel. The walls of these microchannels are denoted by the reference numerals 6, 7, 8, 9, 10, 11, respectively, and their axes by the reference numerals 41, 42, 43, 44, 45, respectively. Portions of the entrance and exit faces of this plate and of the screen and the photocathode of the tube are denoted by the reference numerals 12, 13, 14, 15, respectively.

The screen is provided with an aluminium reflective diaphragm 16 which comprises micro-holes which are distributed at random over the surface of the diaphragm. Each of the reference numerals 17, 18, 19 denotes such a micro-hole.

It is to be noted that the drawing is not to scale. The internal diameter of the channels is on the order of one to several tens of μm, the diameter of the microholes is on the order of 1 μm, and the distance between the screen and the plate is on the order of 1 mm.

The optical feedback towards the photocathode 15 is caused by the light diffused by the screen 14 through the holes such as 17, 18, 19. Behind these holes, the light is diffused in rays contained in the cones having apices 17, 18, 19, respectively, and is incident on the exit face of the plate. FIG. 1 shows the part of these cones which is incident on the part of the plate shown. Their apex angles are A, B, and C, respectively.

The rays coming from the screen, being mainly inclined in the common direction of the axis of the microchannels, are subjected to a number of reflections from the walls of the channels. The reference numeral 20 denotes one of the rays which encloses an angle $\alpha$ with the axis 44 of the microchannel 4 and which is incident substantially on the exit section of this microchannel. When L and d represent the length and the inner diameter of a channel, respectively, the number, n, of reflections to which this ray is subjected is approximately $$n = L/d \tan \alpha.$$

When R is the reflection coefficient of the light from the wall, the fraction of the light transmitted, or the optical transmission, of the ray 20 at the angle x is $$T = R^n = R^{L(\tan \alpha)/d}.$$

Obviously, as $\alpha$ is larger, the number of reflections from the walls of the channels will be larger and the fraction of the transmitted light will be smaller. For example, for a value of the ratio L/d=40, a quite normal value for microchannel plates, and a coefficient R=0.5, the fraction T is on the order of $10^{-3}$ for $\alpha = 14°$. For each channel, the major part of the optical feedback light is thus formed by light diffused in a cone having its apex on the axis of the channel and having a half-angle of $\alpha = 14°$. Such a cone is shown at the entrance of the channel 4 after reflection of the light from the walls of the channel. Its apex is S on the axis 44 and its boundary rays 21 and 22 enclose an angle on the order of 14° with axis 44 and are incident on the entrance section of the channel 4. Similar cones should be imagined on the entrance of the other channels.

Figure 2:
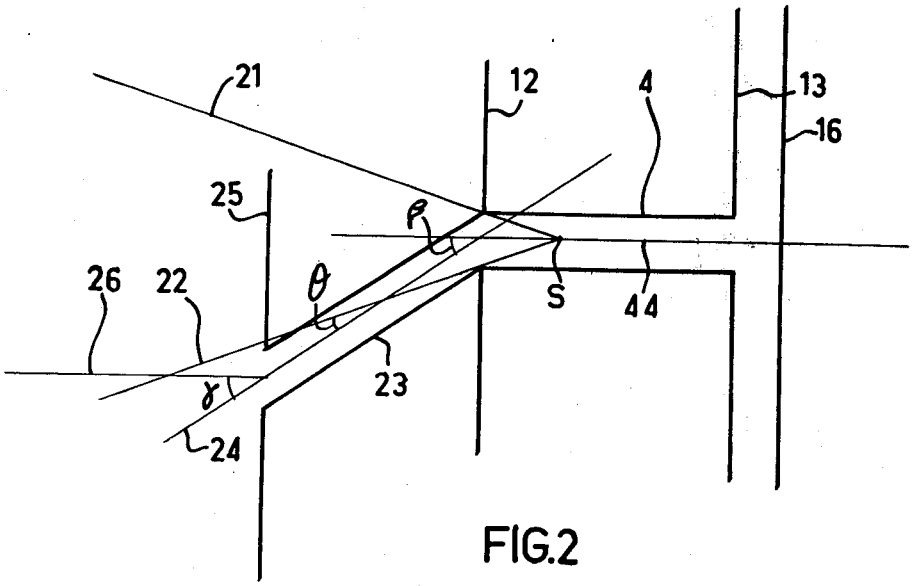
FIG. 2 shows an optical feedback diagram in an image intensifier tube comprising a "chevron-shaped" microchannel.

A first step towards the present invention consists of combining the plate of FIG. 1 with a further channel plate comprising straight channels in a special way in order to form a "chevron" device. This particular association is partly shown in FIG. 2. For the simplicity of the drawing, only a single channel of each plate is shown. A given number of elements shown in FIG. 1 are again shown in FIG. 2 with the same reference numerals. The microchannel from FIG. 1 is the channel 4 with the axis 44. The reference numeral 23 denotes a microchannel of the associated plate. Its axis is denoted by the reference numeral 24. It is inclined with respect to 44.

For the simplicity of the drawing it is assumed that the diameter of the microchannel 4 equals that of the microchannel 23 and that they coincide at their common face 12. Evidently, the invention also applies to the case where these aspects are absent and where the channels do not have the same section. The face of the channel plate having microchannel 23, at the side of the photocathode, is denoted by the reference numeral 25. The reference numerals 21 and 22 denote the boundary rays of a light emission cone inside of which the optical feedback transmission through the microchannel 4 exceeds $10^{-3}$.

In accordance with the foregoing, rays 21 and 22 enclose an angle on the order of 14° with the axis 44 for the chosen plate with L/d=40. In order to ensure that the total optical feedback attenuation of the plate assembly at least equals $10^{+3}$ for all directions of the light, the inclination of the microchannel 23 with respect to the microchannel 4 is such that the ray 22 encloses an angle $\theta \geqq 14°$. The angle $\beta$ between the axes 44 and 24 thus at least equals 28°.

Figure 3:
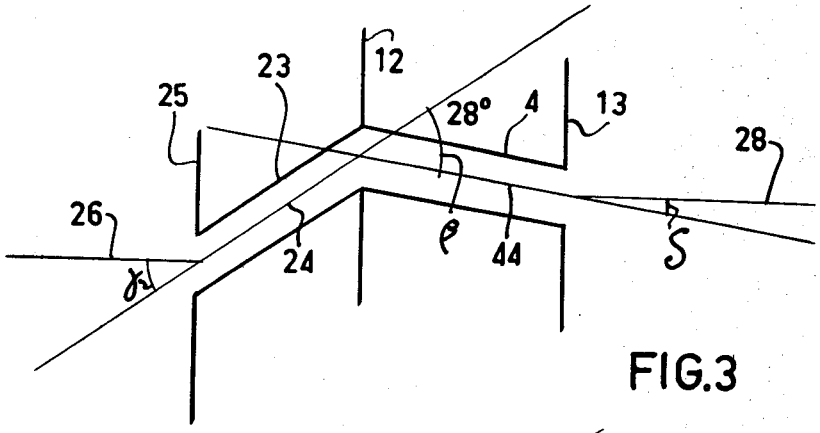
FIG. 3 shows another "chevron-shaped" microchannel.

The reference numeral 26 denotes the normal to the entrance face of the chevron. The angle between the normal 26 and the axis 24, $\gamma$, is equal to the angle $\beta$, and is therefore $\geqq 28°$. This value is too high to ensure suitable detection of the photoelectrons and normal operation of the intensifier tube. Obviously, the faces of the plates could be worked before being associated such that this angle $\gamma$ is smaller, while maintaining a substantial angle between the axes of the channels of the two plates. Thus, for example, a structure as shown in FIG. 3 could be achieved. The detection of the photoelectrons would take place at the entrance of the chevron on the face 25 at an angle $\gamma$ of, for example, 15°, while form the viewpoint of the image the angle $\delta$ between the normal 28 to the face 13 and the axis 44 of the channel would be 13°. As has already been stated, these values of the angles are too high.

Figure 4:
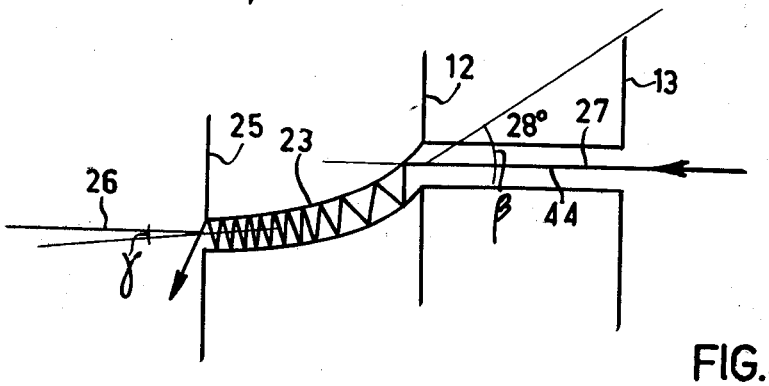
FIG. 4 shows a first embodiment of an electron multiplier in accordance with the invention.

According to the present invention, the channels of at least one of the plates are curved while maintaining a large angle between the axes of the channels of the two plates at the junction of these plates. The structure obtained in a first embodiment according to with the invention is shown in FIG. 4 in which the various elements are denoted by the same reference numerals as used in FIG. 2. The channel 23 exhibits a pronounced curvature at the area of the common face 12, while the part of the channel near the face 25 has a quasi-rectilinear form. As a result, the angle $\beta$ of the axes of the channels at the area 12 (adjacent first ends faces) is maintained at a high value, for example 28° as in FIG. 2, while the angle $\gamma$ (at the second end faces) is small, for example less than 10°, and the angle $\delta$ is near zero. As a result, as in the FIGS. 2 and 3, all light rays from the screen, for example the ray 27 emitted parallel to axis 44, are subjected to an attenuation which is greater than or equal to $10^{+3}$, due to the numerous reflections taking place from the wall of the channel 23, so that suitable detection of the photoelectrons on the entrance of the multiplier and formation of the electronic image spot on its exit are ensured.

Figure 5:
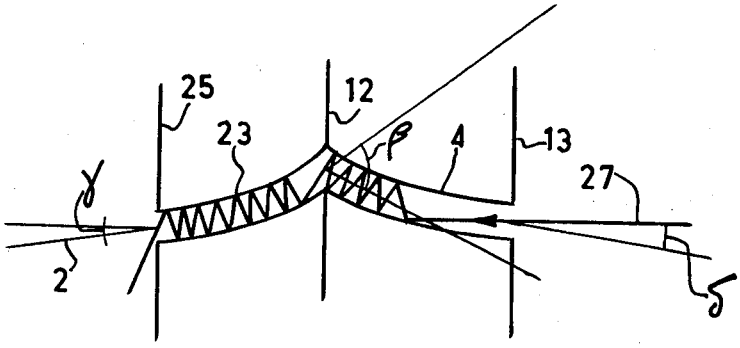
FIG. 5 shows a second embodiment of an electron multiplier in accordance with the invention.

FIG. 5 shows a second embodiment according to the invention which is even more efficient than the preceding one for attenuation of optical feedback. Each of the channels 4 and 23 exhibits a pronounced curvature at the common face 12 of the plates, while the part of the channels near the faces 13 and 25 are quasi-rectilinear. As a result of the curvature of the channels of the two plates, the light rays from the screen, for example the ray 27 which is emitted perpendicular to the face 13, are subjected to a first attenuation which is greater than or equal to $10^{+3}$ during their passage through the channel 4, followed by an analogous attenuation in the channel 23.

Comparative measuring results of the optical attenuation 1/T with light diffused in plates having different characteristics and with different association of the plates according to the invention are shown in the following table in which L and d indicate the length and the diameter, respectively, of the channels of the plates.

TABLE

| Nature of the plates and their associations | Optical attenuation $\frac{1}{T}$ measured in diffused light |
|---|---|
| 1 plate with straight channels, channel axes inclined 6° with respect to the normal to the faces | |
| $d = 12.5\ \mu m, \frac{L}{d} = 40$ | 100 |
| 1 plate with curved channels | |
| $d = 12.5\ \mu m, \frac{L}{d} = 80$ | 1,050 |
| 2 plates with straight channels, axis of channels inclined 6° to the normal to the faces | |
| $d = 12.5\ \mu m, \frac{L}{d} = 40$ | |
| - parallel channels | 1,270 |
| - chevron channels | 70,000 |
| 2 plates, one with straight channels and the other with curved channels. Plate with straight channels: | |
| $d = 12.5\ \mu m, \frac{L}{d} = 40$ | |
| Axis of the channels inclined 6° with respect to the normal to the faces. Plate with curved channels: | |
| $d = 12.5\ \mu m, \frac{L}{d} = 80$ | |
| Curvature: angle of 25° between the directions of the axis at the two contacting faces of the plates | 1,050,000 |
| 2 plates with curved channels | |
| $d = 16\ \mu m, \frac{L}{d} = 80$ | |
| Curvature: angle of 25° between the directions of the axis at the level of the two contacting faces of the plates | 2,500,000 |

Examination of these results, given by way of example, indicates that for image intensifiers comprising a two-stage multiplier, the invention provides an increased optical feedback attenuation on the order of 15 times when the channels of one of the plates are curved, and on the order of 36 times when the channels of both plates are curved as compared to the attenuation provided by two plates with straight channels in a chevron-shaped orientation.

What is claimed is:

1. An electron multiplier device of the type comprising two superposed microchannel plates exhibiting secondary electron emission, said plates each having a first end face and a second end face, the first end faces being adjacent each other, each of the microchannels defining an axis;

CHARACTERIZED IN THAT:

at least one plate comprises curved channels such that the angle between the axes of the channels of the two plates is at least approximately 25° at the first end faces of the plates, while the angle between the axes at the second end faces and a normal to the second end faces is at most 10°.

2. An electron multiplier device as claimed in claim 1, CHARACTERIZED IN THAT one plate comprises curved channels and the other plate comprises straight channels.

3. An electron multiplier device as claimed in claim 1, CHARACTERIZED IN THAT both plates comprise curved channels.

4. An electron multiplier device as claimed in claim 2 or 3, CHARACTERIZED IN THAT the angle between the axes of the channels of the two plates at the first end faces of the plates is at most 30°.

5. An image intensifier tube of the type comprising a photocathode, a screen, and a microchannel plate between the photocathode and screen, CHARACTERIZED IN THAT the microchannel plate comprises two superposed microchannel plates exhibiting secondary electron emission, said plates each having a first end face and a second end face, the first end faces being adjacent each other, each of the microchannels defining an axes; and at least one plate comprises curved channels such that the angle between the axes of the channels of the two plates is at least approximately 25° at the first end faces of the plates, while the angle between the axes at the second end faces and a normal to the photocathode and the screen is at most 10°.

* * * * *